US006626084B1

(12) United States Patent
Nakayama et al.

(10) Patent No.: US 6,626,084 B1
(45) **Date of Patent: *Sep. 30, 2003**

(54) SEMI-SPHERICAL SHOE

(75) Inventors: Seiichi Nakayama, Toyota (JP); Shogo Muramatsu, Toyota (JP); Akira Takenaka, Toyota (JP)

(73) Assignee: Taiho Kogyo Co., Ltd., Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/889,710

(22) PCT Filed: Nov. 24, 2000

(86) PCT No.: PCT/JP00/08269

§ 371 (c)(1),
(2), (4) Date: Jul. 18, 2001

(87) PCT Pub. No.: WO01/38734

PCT Pub. Date: May 31, 2001

(30) Foreign Application Priority Data

Nov. 26, 1999 (JP) ..... 11-335611

(51) Int. Cl.[7] ..... F01B 3/00

(52) U.S. Cl. ..... 92/71

(58) Field of Search ..... 92/71

(56) References Cited

U.S. PATENT DOCUMENTS 4,641,570 A * 2/1987 Futamura et al. ..... 92/71
6,024,010 A * 2/2000 Kato et al. ..... 92/71

* cited by examiner

*Primary Examiner*—D. Daniel Lopez
(74) *Attorney, Agent, or Firm*—Flynn, Thiel, Boutell & Tanis, P.C.

(57) ABSTRACT

A semi-spherical shoe 1 includes an end face 1B which is disposed in sliding contact with a swash plate 3 and a semi-spherical surface 1A which is disposed in sliding contact with a semi-spherical recess 2A formed in a piston 2. A spherical recess 1C is formed in the top portion of the semi-spherical surface 1A to define a space 4 which serves as a reservoir of lubricant oil between the spherical recess 1C and the semi-spherical recess 2B. If the volume of the space 4 which serves as a reservoir of lubricant oil is increased, an accumulation of abraded power in the spherical recess 1C which forms the space can be prevented in a favorable manner.

3 Claims, 4 Drawing Sheets

SEMI-SPHERICAL SHOE

FIELD OF THE INVENTION

The invention relates to a semi-spherical shoe, and in particular to a semi-spherical shoe which is preferred to be interposed between a piston and a swash plate of a swash plate compressor, for example.

THE PRIOR ART

The use of a semi-spherical shoe having a semi-spherical surface which is fitted into a semi-spherical recess formed in a piston and an end face which is disposed in sliding contact with a flat surface of a swash plate in a swash plate compressor is known in the art.

Several arrangements are known in the art which are directed to preventing a seizure when a swash plate compressor is started or at low temperatures, by reducing a sliding resistance between the semi-spherical shoe and the piston. Specifically, in a first arrangement, a top portion of the semi-spherical surface is formed with a curvature which is greater than the curvature of the semi-spherical recess to form a space between the top portion and the semi-spherical recess which acts as a reservoir for a lubricant oil. In a second arrangement, the semi-spherical surface of the semi-spherical shoe is cut through a top portion thereof to provide a flat surface so that a space may be provided between the flat surface and the semi-spherical recess in the piston to provide a reservoir of lubricant oil. In a third arrangement, an axially depressed opening is formed in the top portion of the semi-spherical surface to form a space between the opening and the semi-spherical recess in the piston to serve as a reservoir for a lubricant oil.

However, in the first and the second arrangement, the space which is intended to be a reservoir of lubricant oil has a reduced volume, allowing only a limited quantity of oil to be maintained in the space.

In the third arrangement, the space formed between the opening and the semi-spherical recess has an increased volume to allow an increased quantity of oil to be maintained therein, but a flow of the lubricant oil from within the space to a region of sliding contact which is disposed externally of the space is degraded. As a consequence, there result disadvantages that it is difficult to change the lubricant oil in the space and that an accumulation of abraded powder is likely to occur in the opening.

DISCLOSURE OF THE INVENTION

In view of the forgoing, it is an object of an invention to provide a spherical shoe in which the volume of the space mentioned above is increased in comparison to the first and second arrangement mentioned above while improving the flow of the lubricant oil between inside and outside the space in comparison to the third arrangement.

At this end, in a semi-spherical shoe having a semi-spherical surface which is fitted into a semi-spherical recess of a first movable member and an end face which is disposed in sliding contact with a flat surface of a second movable member, in accordance with the invention, a spherical recess is formed in a top portion of the semi-spherical surface.

With this arrangement, a space may be formed between the spherical recess and the semi-spherical recess which has an increased volume, and the smoothness of the spherical and the semi-spherical recess which form together the space allows the lubricant oil in the space to be smoothly changed.

In this manner, an accumulation of abraded powder in the spherical recess can be prevented in a favorable manner while increasing the volume of the space which serves as a reservoir of lubricant oil.

BEST MODES OF CARRYING OUT THE INVENTION

Figure 1:
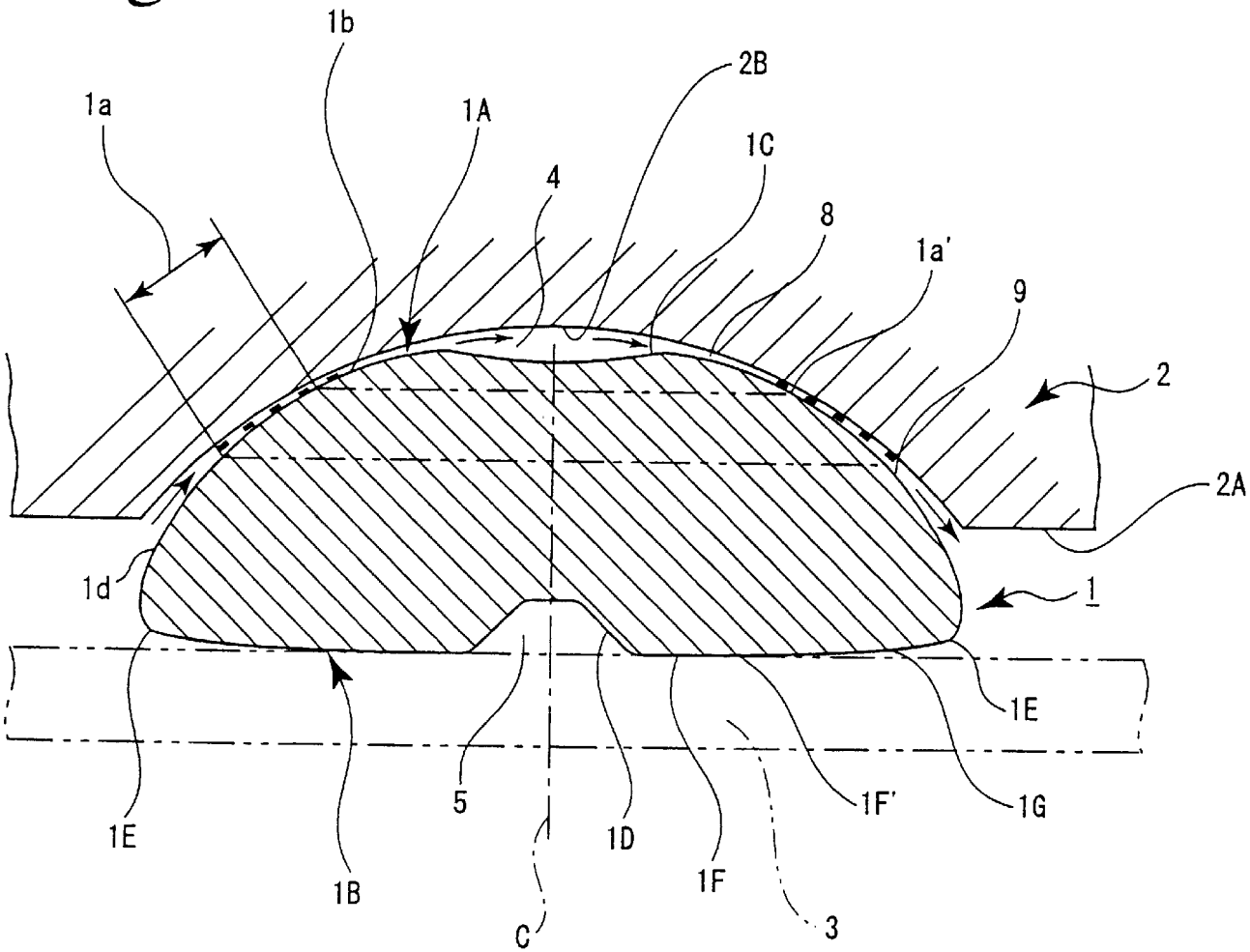
FIG. 1 is a cross section of an essential part of a swash plate compressor according to a first embodiment of the invention.
Figure 2:
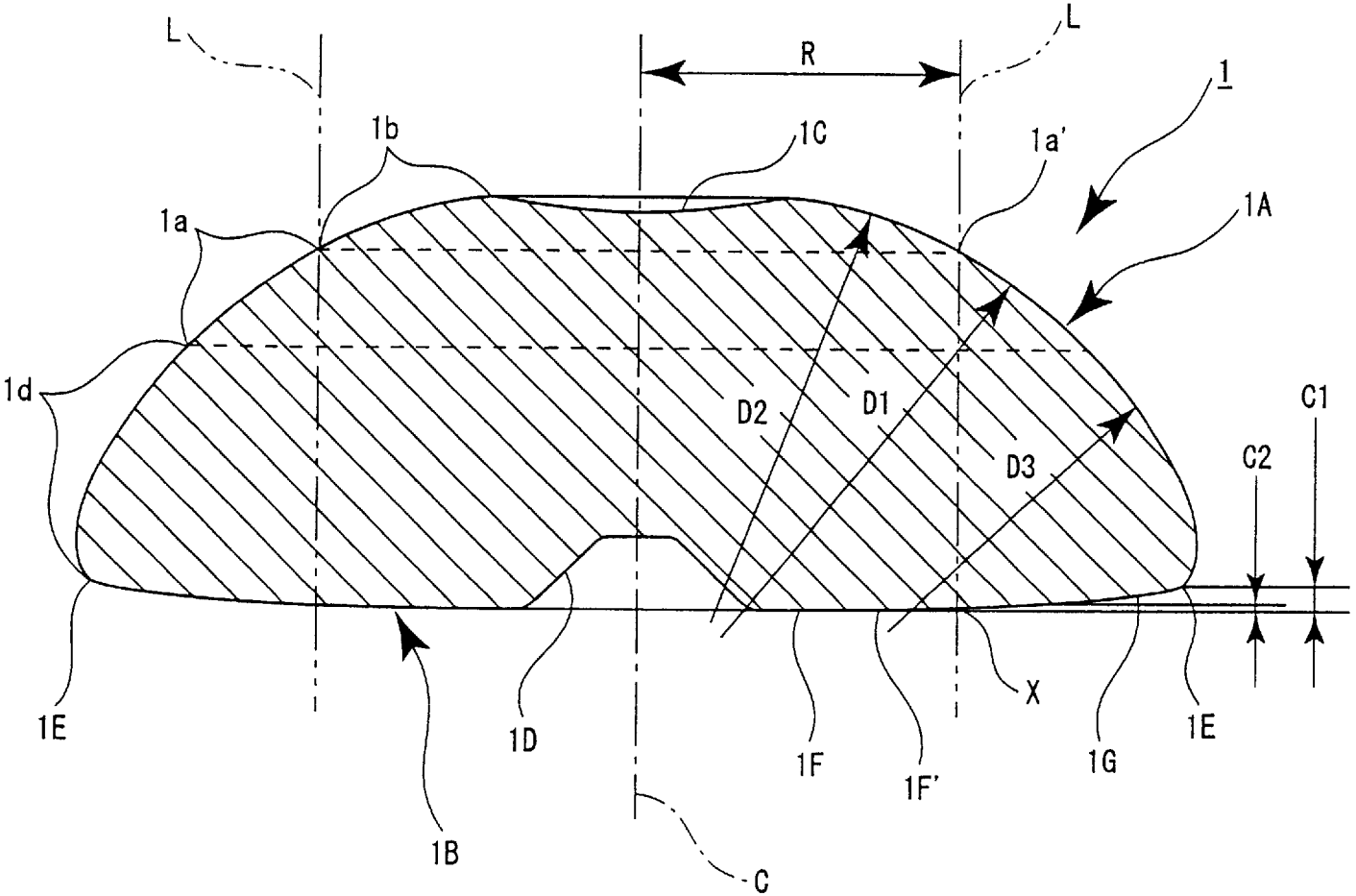
FIG. 2 is an enlarged view of part shown in FIG. 1.

Several embodiments of the invention will now be described with reference to the drawings. FIGS. 1 and 2 show an embodiment of a sliding system according to the invention as applied to a swash plate compressor. Specifically, a swash plate compressor comprises a semi-spherical shoe 1, a piston 2 which is driven for reciprocating motion in the vertical direction as viewed in FIG. 1, and a flat swash plate 3 which is driven for rotation by a rotary shaft. The piston 2 has an end face 2A, in which a semi-spherical recess 2B is formed. In this embodiment, the semi-spherical recess 2B is formed with a common curvature over the entire area.

The semi-spherical shoe 1 includes a semi-spherical surface 1A and a flat end face 1B. As will be further described later, an axial top portion (as viewed in FIG. 1) of the semi-spherical surface 1A is slightly notched in a direction perpendicular to an axis C to define a shallow spherical recess 1C. A region of the end face 1B located toward the axis or the center is formed with a substantially conical opening 1D. The spherical recess 1C at the top of the spherical shoe has a depth which is chosen to be on the order of about one-third the depth of the opening 1D formed in the end face 1B toward the axis.

The semi-spherical shoe 1 is used by fitting the semi-spherical surface 1A into the semi-spherical recess 1B in the piston 2 while disposing the end face 1B in abutment against the swash plate 3. When the semi-spherical shoe 1 is interposed in this manner between the semi-spherical recess 2B and the swash plate 3, a region of the semi-spherical surface 1A which is located toward a boundary 1E between the semi-spherical surface 1A and the end face 1B is exposed in a space between the end face 2A of the piston 2 and the swash plate 3.

A space 4 is defined between the spherical recess 1C and the semi-spherical recess 2B in the piston 2, and a space 5 is defined between the opening 1D and the swash plate 3. These spaces 4 and 5 serve as a temporary reservoir of lubricant oil.

When the swash plate 3 is driven for rotation, the piston 2 is driven for reciprocating motion through the semi-spherical shoe 1. At this time, the end face 1B of the semi-spherical shoe 1 slides relative to the swash plate 3, and the semi-spherical surface 1A slides relative to the semi-spherical recess 2B. During this process, the lubricant oil which is stored in the spaces 4 and 5 permeates into the regions of sliding contacts of the semi-spherical surface 1A and the end face 1B, thus lubricating and cooling these regions.

Figure 3:
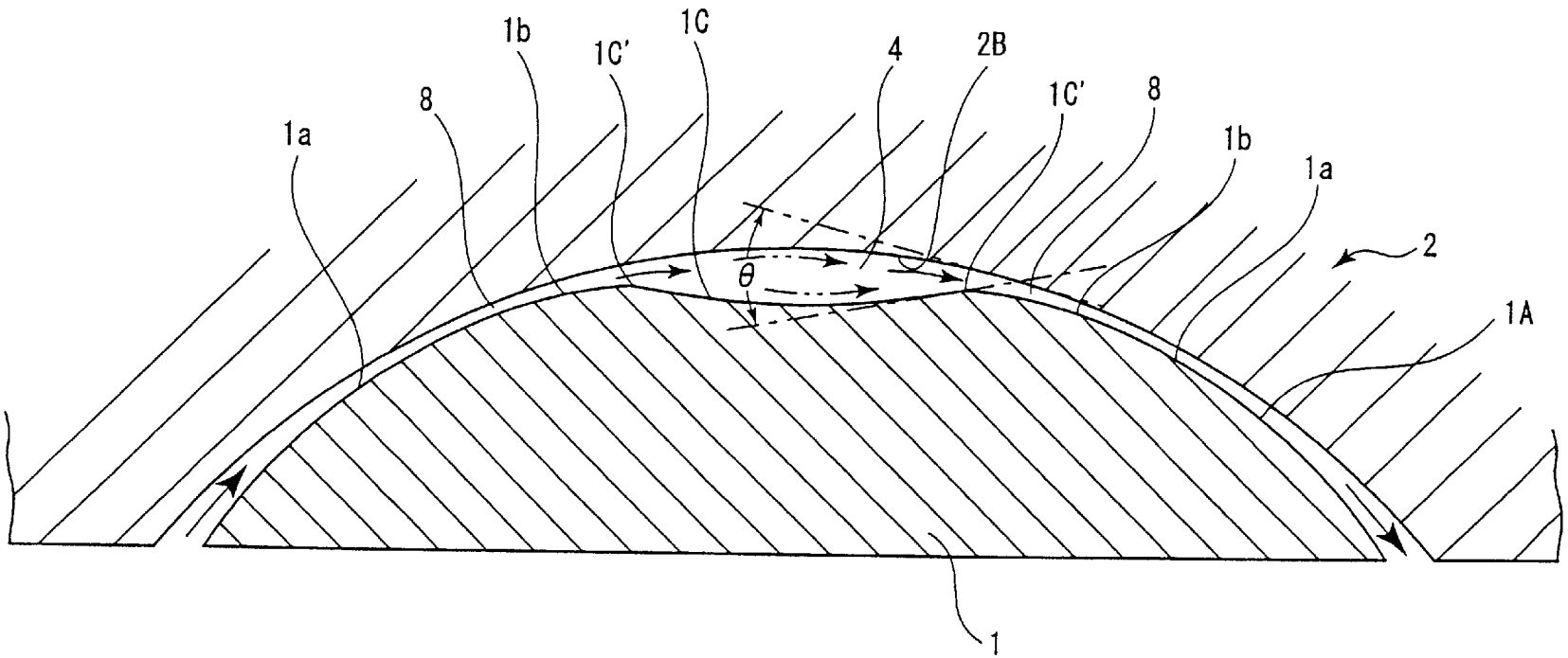
FIG. 3 is an enlarged view of part shown in FIG. 1.

As shown to an enlarged scale in FIG. 3, the spherical recess 1C formed in the present embodiment represents part of a smooth spherical surface having a uniform curvature. A periphery 1C' of the spherical recess 1C, which represents a junction with a lead-in 1*b* to be described later, is formed to depict a smooth arc in section. An angle θ formed between the region of the periphery 1C' of the spherical recess 1C and the semi-spherical recess 2B is chosen to be in a range from 5° to 30° in the present embodiment. However, the angle θ may be in a range from 50° to 65°.

In this embodiment, the semi-spherical surface 1A includes a sliding contact region 1*a* of a diameter D1, and a lead-in 1*b* of a diameter D2 which is located above the sliding contact region 1*a* or disposed toward the spherical recess 1C, the diameter D2 being different from the diameter D1.

Thus, the semi-spherical shoe 1 of this embodiment is not in sliding contact with the semi-spherical recess 2B over the entire semi-spherical surface 1A, but an annular region located between the end face 1B and the top spherical recess 1C and disposed close to the latter defines the sliding contact region 1*a* which is disposed in sliding contact with the semi-spherical recess 2B.

Another annular region of the semi-spherical surface 1A which is located above the sliding contact region 1*a* or disposed toward the spherical recess 1C defines the lead-in 1*b*, and a further annular region disposed below the sliding contact region 1*a*, or toward the end face 1B defines a non-sliding contact region 1*d* which is not disposed in sliding contact with the semi-spherical recess 2B.

In this embodiment, the diameter D2 of the lead-in 1*b* is greater than the diameter D1 of the sliding contact region 1*a* of the semi-spherical surface 1A. This allows a clearance 8 which gradually increases toward the top or the spherical recess 1C to be formed between the lead-in 1*b* and an opposing portion of the semi-spherical recess 2B in the piston 2 (see FIG. 1). Sizes of various parts are adjusted so that the clearance 8 has a maximum size from 5 to 500 μm.

As a result of this, a reservoir of lubricant oil stored in the space 4 formed between the semi-spherical recess 2B and the spherical recess 1C in the semi-spherical shoe 1 is smoothly introduced toward and into the sliding contact region 1*a* through the clearance 8.

The diameter D3 of the non-sliding contact region 1*d* disposed toward the end face 1B is less than the diameter D1 of the sliding contact region 1*a*, whereby a clearance 9 which gradually increases toward the end face 1B is formed between the non-sliding contact region 1*d* and an opposing portion of the semi-spherical recess 2B in the piston 2. In this manner, the lubricant oil which is distributed around the sliding contact region 1*a* is easily displaced toward the end face 1B through the clearance 9.

The surface of the sliding contact region 1*a* of the semi-spherical surface 1A may be coated by a resin film containing $Mo^{S_2}$, Gr or the like. Alternatively, the surface of the sliding contact region 1*a* of the semi-spherical surface 1A may be subject to a soft nitriding treatment before it is coated with a resin film containing $Mo^{S_2}$, Gr or the like. As a further alternative, the surface of the sliding contact region 1*a* of the semi-spherical surface 1A may be coated by a hard film layer which is selected from DLC (amorphous carbon film), Ni—P plating and Ni—B plating. By coating the surface of the sliding contact region 1*a* in this manner, it is possible to prevent a seizure of the sliding contact region 1A from occurring.

In this embodiment, a region of the end face 1B of the semi-spherical shoe 1 which is located toward the axis or the opening 1D bulges toward the swash plate 3 beyond the boundary 1E which defines the outer periphery thereof. The region disposed toward the axis is formed as a flat surface, which defines a sliding contact region 1F which is disposed in sliding contact with the swash plate 3.

On the other hand, a region extending from an outer edge 1F' of the sliding contact region 1F to the boundary 1E is formed so as to depict a gentle arc in section. This region defines a non-sliding contact region 1G which is not disposed in sliding contact with the swash plate 3.

In the present embodiment, the non-sliding contact region 1G is formed such that the outer edge 1F' of the sliding contact region 1F is located nearer the axis C than the distance or radius R by which the upper edge 1*a*', which means an edge located toward the top or the spherical recess 1C, of the sliding contact region 1*a* of the semi-spherical surface 1A is spaced from the axis C. (FIG. 2.)

When an imaginary line L is drawn parallel to the axis C so as to intersect with the edge 1*a*', a point X where the line L intersects with the non-sliding contact region 1G, the sliding contact region 1F and the boundary 1E are related to each other such that denoting a distance by which the sliding contact region 1F and the boundary 1E are spaced axially (or a bulge of the sliding contact region 1F) by C1 and a distance by which the sliding contact region 1F and the point X are spaced axially by C2, as indicated in FIG. 2, the inequality $C2/C1 \leqq 0.3$ is satisfied.

A choice of sizes as mentioned above allows a region of the end face 1B which is located toward the axis (or the sliding contact region 1F) to bulge beyond the boundary 1E which defines the outer periphery.

Figure 4:
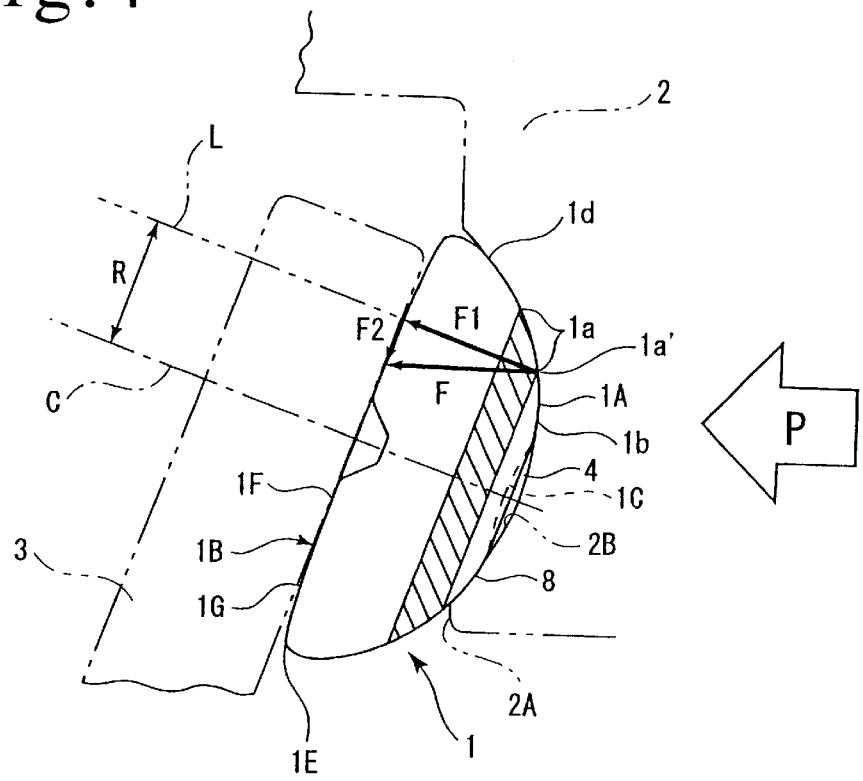
FIG. 4 shows an operating condition of a swash plate compressor shown in FIG.1.

As a consequence, during an actual use of the semi-spherical shoe 1, a maximum load P applied to the piston 2 along the axis thereof is supported by the sliding contact region 1F of the end face 1B which is disposed on the swash plate 3 which assumes a most skewed position, as shown in FIG. 4. Accordingly, during the operation of the swash plate compressor, the semi-spherical shoe 1 which is interposed between the semi-spherical recess 2B in the piston 2 and the swash plate 3 assumes a greatly stabilized position. In the condition shown in FIG. 4, the sliding contact region 1*a* of the semi-spherical surface 1A is partly exposed in a space between the end face 2A of the piston 2 and the swash plate 3, whereby the lubricant oil is guided into the region of sliding contact between the sliding contact region 1*a* and the semi-spherical recess 2B.

As mentioned above, in the present embodiment, the spherical recess 1C is formed in the top of the semi-spherical shoe 1. This allows the space 4 formed between the spherical recess 1C and the semi-spherical recess 2B in the piston 2 to be increased in volume in comparison to the prior art, allowing the quantity of lubricant oil which is stored therein to be increased than before.

Also, as mentioned above, in the semi-spherical shoe 1 of this embodiment, the diameter D2 of the lead-in 1*b* is greater than the diameter D1 of the sliding contact region 1*a* to define the clearance 8 when the semi-spherical shoe 1 is fitted into the semi-spherical recess 2B in the piston 2. Accordingly, a reservoir of lubricant oil which is stored in the space 4 between the spherical recess 1C of the semi-spherical shoe 1 and the semi-spherical recess 2B in the piston 2 is smoothly introduced toward and into the sliding contact region 1*a* through the clearance 8, as indicated by arrows in FIG. 1. Accordingly, the sliding response of the semi-spherical shoe 1 can be improved over the prior art.

As shown in FIG. 3, during the operation of the swash plate compressor, the lubricant oil is introduced into the spherical recess 1C (or the space 4) through the clearance 9, the sliding area of the sliding contact region 1*a* and the clearance 8, whereby a reservoir of lubricant oil which has been stored in the space 4 is displaced toward the swash plate 3 through a flow path which is opposite to the path mentioned above.

The lubricant oil which is introduced into the space 4 is allowed to flow smoothly along the surfaces of the spherical recess 1C and the semi-spherical recess 2A, as indicated by phantom line arrows in FIG. 3, thus smoothly changing the lubricant oil in the space 4. In this manner, an accumulation of abraded power in the space 4 can be prevented in a favorable manner.

In addition, in this embodiment, the described choice of sizes allows a region of the end face 1B disposed toward the axis (or the sliding contact region 1F) to bulge beyond the outer periphery (or the non-sliding contact region 1G). This stabilizes the position of the semi-spherical shoe 1 during the operation of the swash plate compressor, and enhances the lubricating and cooling effects of the lubricant oil upon moving parts.

Second Embodiment

Figure 5:
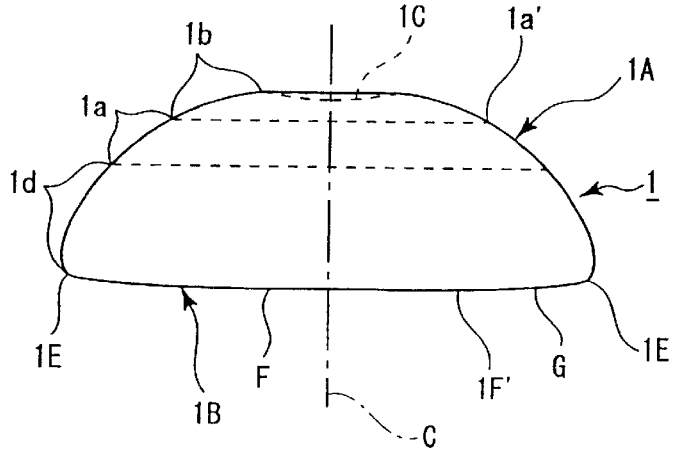
FIG. 5 is a front view of a second embodiment of the invention.

FIG. 5 shows a second embodiment of semi-spherical shoe 1 where the opening 1D formed in the end face 1B of the semi-spherical shoe 1 shown in the first embodiment is omitted. In other respects, the arrangement is similar to the first embodiment. Again, a similar functioning and effect can be achieved as achieved in the first embodiment.

In the embodiments described above, the diameter D2 of the lead-in 1*b* is chosen to be greater than the diameter D1 of the sliding contact region 1*a* of the semi-spherical shoe 1 to define the clearance 8. However, both the lead-in 1*b* and the sliding contact region 1A of the semi-spherical shoe 1 may have an equal diameter while changing the curvatures of the semi-spherical recess 2A in the piston 2 at opposing locations to allow the clearance 8 to be formed.

While above embodiments have been described as an application of a sliding system according to the invention to a piston, a semi-spherical shoe and a swash plate of a swash plate compressor, the invention is also applicable to a wobble plate oil pump. In addition, the sliding system of the invention is also applicable to a mechanical component having a semi-spherical recess in which a semi-spherical shoe is fitted.

As discussed above, in accordance with the invention, there is obtained an advantage that an accumulation of abraded power in a spherical recess can be prevented in a favorable manner while increasing the volume of a space which serves as a reservoir of lubricant oil in comparison to the prior art.

What is claimed is:

1. A sliding system including a first movable member having a semi-spherical recess, a second movable member having a flat surface and a semi-spherical shoe having a semi-spherical surface which is fitted into the semi-spherical recess of the first movable member and an end face which is disposed in sliding contact with the flat surface of the second movable member, wherein an annular sliding contact region is formed on the semi-spherical surface in a region provided between the top of the shoe and the end face, a lead-in region is located on the semi-spherical surface above the annular sliding contact region and surrounds a concave recess provided therein, the semi-spherical surface being arranged in the semi-spherical recess such that a space is formed between the concave recess and the semi-spherical recess for replacing a lubricant contained therein through a clearance formed between the lead-in region and an opposing portion of the semi-spherical recess which gradually increases toward the top of the semi-spherical surface, the end face of the shoe comprises a flat annular sliding portion in slidable contact with the flat surface of the second movable member, an opening provided in the end face of the shoe to form a space between the second movable member and the shoe end face for containing a lubricant therein and a concave portion extending from the flat annular sliding portion and away from the second movable member and the outer perimeter of the flat annular sliding portion is located closer to the vertical axis line of the shoe than the inner perimeter of the annular sliding contact region.

2. The sliding system of claim 1, wherein a peripheral portion of the concave recess forms an angle from 5–65 degrees with respect to the semi-spherical recess provided in the first movable member.

3. The sliding system of claim 1, wherein the first movable member comprises a piston of a swash plate compressor and the second movable member comprises a swash plate of the swash plate compressor.

* * * * *